US008259956B2

(12) United States Patent
Yamaoka et al.

(10) Patent No.: US 8,259,956 B2
(45) Date of Patent: Sep. 4, 2012

(54) INFORMATION PROCESSING APPARATUS AND INFORMATION PROCESSING METHOD

(75) Inventors: Katsumi Yamaoka, Saitama (JP); Hideto Saraoka, Kanagawa (JP); Toshie Oinuma, Tokyo (JP)

(73) Assignee: Sony Corporation, Tokyo (JP)

( * ) Notice: Subject to any disclaimer, the term of this patent is extended or adjusted under 35 U.S.C. 154(b) by 326 days.

(21) Appl. No.: 12/613,669

(22) Filed: Nov. 6, 2009

(65) Prior Publication Data

US 2010/0166205 A1 Jul. 1, 2010

(30) Foreign Application Priority Data

Dec. 26, 2008 (JP) ..... 2008-334212

(51) Int. Cl.
*H04R 1/10* (2006.01)
*H04R 25/00* (2006.01)
*G10K 11/16* (2006.01)

(52) U.S. Cl. ..... 381/74; 381/71.6; 381/71.2; 381/71.1; 381/384

(58) Field of Classification Search ..... 381/71.1, 381/71.2, 71.5, 71.6, 71.8, 74, 384
See application file for complete search history.

(56) References Cited

U.S. PATENT DOCUMENTS 4,237,449 A * 12/1980 Zibell ..... 340/407.1
6,118,878 A 9/2000 Jones
2004/0264703 A1* 12/2004 Fujita ..... 381/1
2008/0175402 A1 7/2008 Abe et al.

FOREIGN PATENT DOCUMENTS

| | | |
|---|---|---|
| JP | 03-274894 | 12/1991 |
| JP | 08-510565 | 11/1996 |
| JP | 2008-60759 | 3/2008 |
| JP | 2008-92366 | 4/2008 |
| JP | 2008-99163 | 4/2008 |

OTHER PUBLICATIONS

Office Action issued Nov. 24, 2010, in Japanese Patent Application No. 2008-334212.

* cited by examiner

*Primary Examiner* — Devona Faulk
*Assistant Examiner* — George Monikang
(74) *Attorney, Agent, or Firm* — Oblon, Spivak, McClelland, Maier & Neustadt, L.L.P.

(57) ABSTRACT

An information processing apparatus includes a jack, a noise-canceling section, a judgment section, and a first regulation section. The jack is connectable with a plug of a headphone including a microphone, outputs a first signal to the headphone, and inputs a second signal from the microphone. The noise-canceling section generates a third signal that cancels a noise component around the headphone based on the second signal input from the jack and enables an operation of superposing the third signal on the first signal. The judgment section judges whether at least one of the first signal and the second signal exceeds a predetermined level. The first regulation section regulates an operation of the noise-canceling section when the judgment section detects that the predetermined level is exceeded.

5 Claims, 11 Drawing Sheets

INFORMATION PROCESSING APPARATUS AND INFORMATION PROCESSING METHOD

BACKGROUND OF THE INVENTION

1. Field of the Invention

The present invention relates to an information processing apparatus such as a laptop personal computer and an information processing method.

2. Description of the Related Art

Generally, a noise-canceling headphone or earphone that is structured so as to be detachable from an information processing apparatus such as a laptop personal computer includes a pin-like plug. The pin-like plug is provided with a plurality of plug terminals that are arranged in an insertion/extraction direction with respect to a jack provided to the information processing apparatus. To correspond to the plug terminals, connector terminals on the jack side are also arranged in the insertion/extraction direction of the plug.

The noise-canceling headphone includes a microphone that collects surrounding sounds as noises. In the plug of the noise-canceling headphone, a microphone input terminal and a speaker output terminal are arranged in the insertion/extraction direction of the plug. When the plug is inserted into/extracted from the jack, there may be a case where a terminal on the plug side and a terminal on the jack side that are not in a correspondence relationship are brought into contact with each other. In this case, upon contact of the speaker output terminal on the plug side and a microphone input terminal on the jack side when a noise-canceling function is in on-state, an output from a speaker is partially fed back to the microphone, thus causing oscillation (howling).

In the technique described in Japanese Patent Application Laid-open No. 2008-92366 (paragraphs [0002] to [0004], [0008], etc.; hereinafter, referred to as Patent Document 1), insertion/draw-out of the plug is detected based on a voltage change of a voltage supply line that is connected to an audio signal line and supplies a reference voltage to a microphone through the audio signal line. When draw-out of the plug is detected, an output from a signal amplification means in a signal path is suppressed, with the result that the oscillation described above is prevented.

SUMMARY OF THE INVENTION

In the technique described in Patent Document 1, because the insertion/draw-out of the plug is detected based on the voltage change of the voltage supply line as described above, there is a fear that the noise-canceling function is turned off even when an oscillation does not occur actually. In addition, in the technique described in Patent Document 1, a switch is specially required on the signal path of the audio signal line so that an oscillation is prevented from occurring, resulting in the increased number of components.

There is a need for an information processing apparatus and an information processing method that are capable of suppressing generation of an oscillation reliably with a simple structure.

According to an embodiment of the present invention, there is provided an information processing apparatus including a jack, a noise-canceling section, a judgment section, and a first regulation section.

The jack is connectable with a plug of a headphone including a microphone, outputs a first signal to the headphone, and inputs a second signal from the microphone.

The noise-canceling section generates a third signal that cancels a noise component around the headphone based on the second signal input from the jack and enables an operation of superposing the third signal on the first signal.

The judgment section judges whether at least one of the first signal and the second signal exceeds a predetermined level.

The first regulation section regulates an operation of the noise-canceling section when the judgment section judges that the predetermined level is exceeded.

In the embodiment of the present invention, since the judgment section judges that an oscillation is actually generated, the generation of an oscillation can be suppressed reliably. Further, in the embodiment of the present invention, there is employed the structure in which the operation of the noise-canceling section is regulated when an oscillation is generated, instead of the structure in which a switch provided on the signal path of the audio signal line is turned off when an oscillation is generated (Patent Document 1). The regulation on the operation of the noise-canceling section as described above is a function that has been used from the past in an information processing apparatus including a noise-canceling function. For example, in a case where the noise-canceling function is turned on/off on a user interface screen in accordance with preferences or the like of a user, the function of regulating the operation of the noise-canceling section as described above is employed. In the embodiment of the present invention, such a function of regulating the operation of the noise-canceling section can be used, with the result that a special switch for reliably suppressing the generation of an oscillation does not need to be additionally provided.

The information processing apparatus according to the embodiment of the present invention may further include: a first detection section to detect that a plug is connected to the jack; and a second regulation section to regulate the operation of the noise-canceling section for a predetermined period of time after the first detection section detects that the plug is connected to the jack.

With this structure, the operation of the noise-canceling section is not regulated due to malfunction.

The information processing apparatus according to the embodiment of the present invention may further include: a second detection section to detect that the plug of the headphone including the microphone is connected to the jack; and a release section to release the regulation on the operation of the noise-canceling section by the second regulation section when the second detection section detects that the plug of the headphone including the microphone is connected to the jack.

With this structure, the noise-canceling section operates along with the correct connection of the plug of the headphone including the microphone and the jack.

According to another embodiment of the present invention, there is provided an information processing apparatus including a jack, a noise-canceling section, a switch, a comparator, and a flip-flop.

The jack is connectable with a plug of a headphone including a microphone, outputs a first signal to the headphone, and inputs a second signal from the microphone.

The noise-canceling section generates a third signal that cancels a noise component around the headphone based on the second signal input from the jack and superposes the third signal on the first signal.

The switch makes a switch as to whether the third signal is superposed on the first signal.

The comparator compares one of a first voltage of the first signal and a second voltage of the second signal with a predetermined third voltage and outputs a fourth signal when one of the first voltage and the second voltage exceeds the third voltage.

The flip-flop is capable of holding the fourth signal and outputs a fifth signal with which the switch is turned off when the flip-flop holds the fourth signal.

In the embodiment of the present invention, since the comparator determines that an oscillation is actually generated, the generation of an oscillation can be suppressed reliably with a simple structure.

The information processing apparatus according to the embodiment of the present invention may further include a control section to output a sixth signal with which the switch is turned on. The flip-flop may be capable of holding the sixth signal and turn on the switch when flip-flop holds the sixth signal.

With this structure, the noise-canceling function that is off-state by the operation of the user can be turned on.

In the information processing apparatus according to the embodiment of the present invention, the jack includes a microphone input terminal. The information processing apparatus further includes: a power source to supply power to the microphone input terminal; and a first hysteresis comparator to compare a fourth voltage applied to the microphone input terminal with a predetermined fifth voltage and output a seventh signal when the fourth voltage is lower than the fifth voltage. The control section may turn off the switch for a predetermined period of time when the first hysteresis comparator outputs the seventh signal.

With this structure, the operation of the noise-canceling section is not regulated due to malfunction.

The information processing apparatus according to the embodiment of the present invention further includes a second hysteresis comparator to compare the fourth voltage applied to the microphone input terminal with a predetermined sixth voltage set to be lower than the fifth voltage and output an eighth signal when the fourth voltage is in a range between the fifth voltage and the sixth voltage. The control section may turn on the switch when the second hysteresis comparator outputs the eighth signal.

With this structure, the noise-canceling section operates along with the correct connection of the plug of the headphone including the microphone and the jack.

According to still another embodiment of the present invention, there is provided an information processing method including generating, based on a second signal input from a jack that is connectable with a plug of a headphone including a microphone, outputs a first signal to the headphone, and inputs the second signal from the microphone, a third signal that cancels a noise component around the headphone.

The third signal is superposed on the first signal.

Whether at least one of the first signal and the second signal exceeds a predetermined level is judged.

The superposition of the third signal on the first signal is regulated when it is detected that the predetermined level is exceeded.

In the embodiment of the present invention, since it is determined that an oscillation is actually generated, the generation of an oscillation can be suppressed reliably with a simple structure.

According to the embodiments of the present invention, the generation of an oscillation can be suppressed reliably with a simple structure.

These and other objects, features and advantages of the present invention will become more apparent in light of the following detailed description of best mode embodiments thereof, as illustrated in the accompanying drawings.

DESCRIPTION OF PREFERRED EMBODIMENTS

Hereinafter, embodiments of the present invention will be described with reference to the drawings.

(Structure of Information Processing Apparatus)

Figure 1:
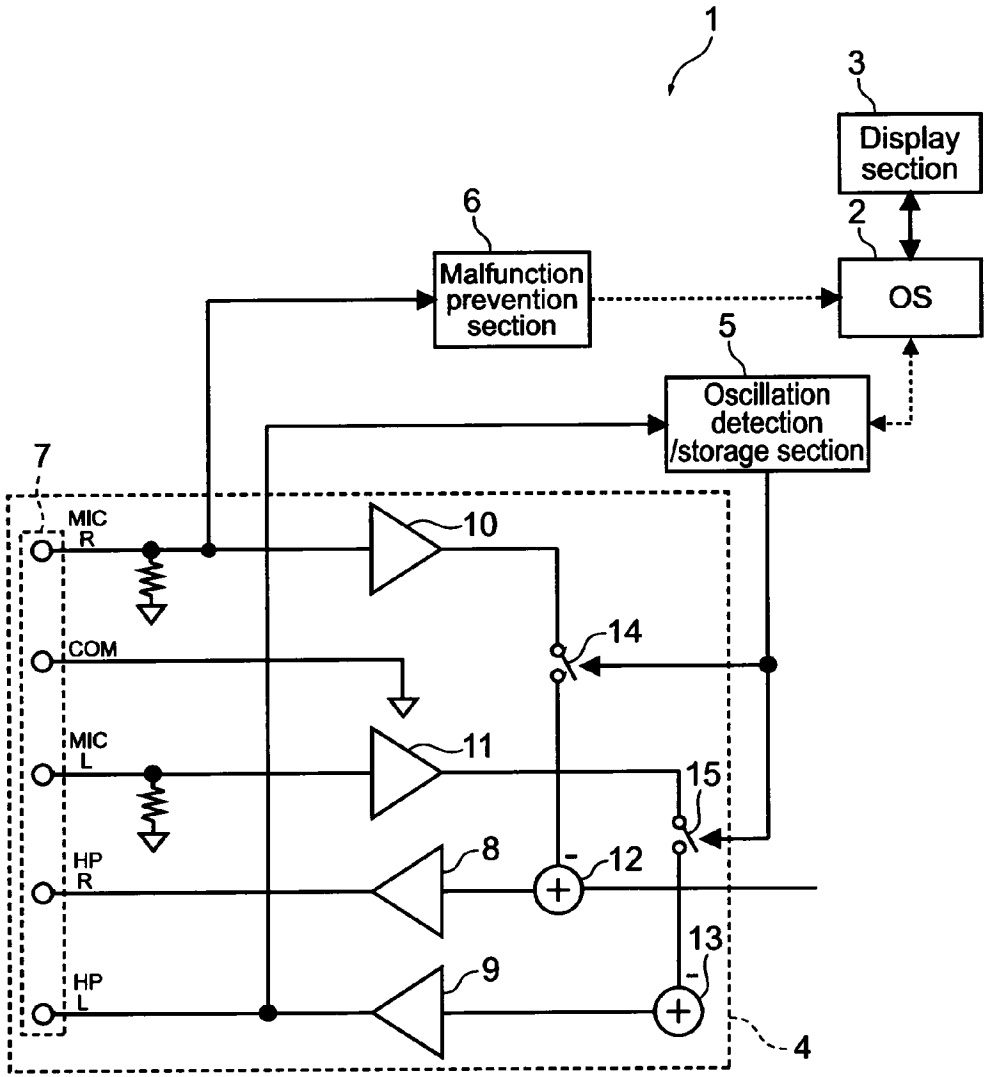
FIG. 1 is a diagram showing a structure of an information processing apparatus according to an embodiment of the present invention.

FIG. 1 is a diagram showing a structure of an information processing apparatus according to an embodiment of the present invention. A laptop personal computer exemplifies the information processing apparatus.

As shown in FIG. 1, an information processing apparatus 1 includes an OS (Operating System) 2, a display section 3, an audio section 4, an oscillation detection/storage section 5, and a malfunction prevention section 6.

The information processing apparatus 1 includes hardware and software that are provided to a general laptop personal computer, though not shown in the figure.

Examples of the hardware include a keyboard, a mouse pointer, a CPU (Central Processing Unit), an MCH (Memory Controller Hub), an ICH (I/O Controller Hub), and an Audio Codec. Examples of the software include a BIOS (Basic Input/Output System) and various application programs, in addition to the OS described above.

The OS 2 is a Windows (registered trademark) system, for example. The OS 2 provides basic functions used in common by a number of application software and controls the whole information processing apparatus 1. The basic functions include an input/output function such as inputs from a keyboard and outputs to a screen and a function of managing a disc and a memory. The OS 2 includes an Audio Driver for managing the Audio Codec and the ICH. The Audio Codec is an LSI (Large Scale Integration) that is used for incorporating a sound function in a mother board (not shown) of the information processing apparatus 1.

The display section 3 is formed of, for example, a liquid crystal display panel.

The audio section 4 includes a headphone-connecting jack 7, audio amplifiers 8 and 9, noise-canceling sections 10 and 11, adders 12 and 13, and switches 14 and 15.

Figure 2:
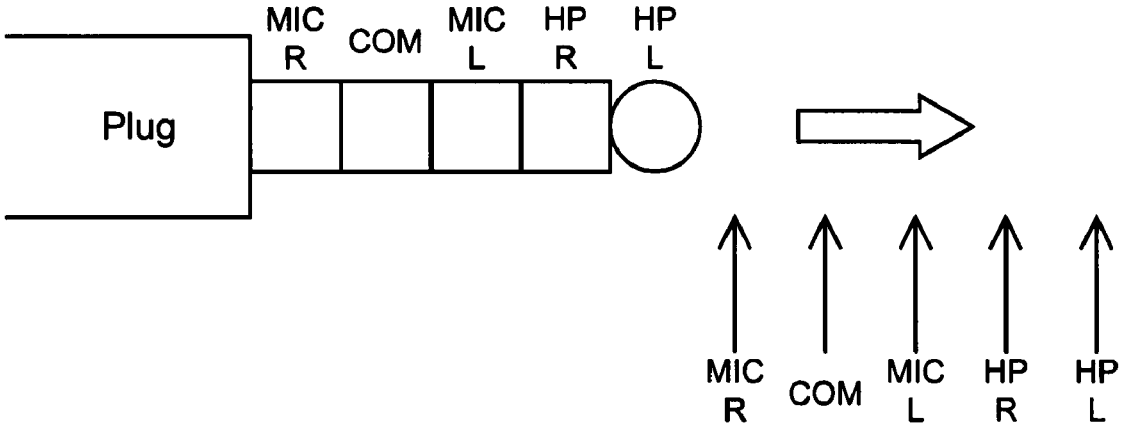
FIG. 2 is a schematic diagram showing a headphone-connecting jack shown in FIG. 1.

The headphone-connecting jack 7 is a 5-pole jack. As schematically shown in FIG. 2, the headphone-connecting jack 7 includes connector terminals of MIC R, COM, MIC L, HP R, and HP L in the stated order from a plug insertion side. The connector terminal MIC R is connected to a right-side microphone plug terminal of a plug of a headphone including a microphone (noise-canceling headphone). The connector terminal COM is connected to a COM terminal of the plug of the headphone including the microphone. The connector terminal MIC L is connected to a left-side microphone plug terminal of the plug of the headphone including the microphone. The connector terminal HP R is connected to a right-side headphone plug terminal of the plug of the headphone including the microphone. The connector terminal HP L is connected to a left-side headphone plug terminal of the plug of the headphone including the microphone. Other than the noise-canceling headphone, a three-pin headphone that is noncompliant with noise-canceling and is not provided with a microphone can also be connected to the headphone-connecting jack 7.

The audio amplifier 8 amplifies a right channel audio signal that is output to the outside from the information processing apparatus 1. The right channel audio signal that has been amplified by the audio amplifier 8 is output to the headphone through the connector terminal HP R of the headphone-connecting jack 7. The audio amplifier 9 amplifies a left channel audio signal that is output to the outside from the information processing apparatus 1. The left channel audio signal that has been amplified by the audio amplifier 9 is output to the headphone through the connector terminal HP L of the headphone-connecting jack 7.

The noise-canceling section 10 has a function of amplifying a signal and generates a signal that cancels noise components around the headphone based on a signal that is input from the connector terminal MIC R of the headphone-connecting jack 7. The noise-canceling section 11 has a function of amplifying a signal and generates a signal that cancels noise components around the headphone based on a signal that is input from the connector terminal MIC L of the headphone-connecting jack 7. The signal that cancels noise components around the headphone refers to, for example, a signal obtained by inverting phases of the noise components. In the noise-canceling sections 10 and 11, frequency characteristics and a level in which the noise components around the headphone are canceled and the like are adjusted by control of the Audio Driver (not shown).

The adder 12 superposes a signal output from the noise-canceling section 10 on a signal input to the audio amplifier 8. The adder 13 superposes a signal output from the noise-canceling section 11 on a signal input to the audio amplifier 9.

The switch 14 makes a switch as to whether the signal output from the noise-canceling section 10 is output to the adder 12. When the switch 14 is in on-state, the signal output from the noise-canceling section 10 is output to the adder 12. When the switch 14 is in off-state, output of the signal to the adder 12, the signal being output from the noise-canceling section 10, is regulated. The switch 15 makes a switch as to whether the signal output from the noise-canceling section 11 is output to the adder 13. When the switch 15 is in on-state, the signal output from the noise-canceling section 11 is output to the adder 13. When the switch 15 is in off-state, output of the signal to the adder 13, the signal being output from the noise-canceling section 11, is regulated. In a case where a user noise-canceling function is tuned on/off using a user interface screen that will be described later, the switches 14 and 15 are tuned on/off under control of the OS 2. That is, when the switches 14 and 15 are tuned off, an audio signal for which the noise-canceling function is set to be off (regulated) is supplied to the headphone. In other words, the audio signal is supplied to the headphone even when the switches 14 and 15 are tuned off.

(Structure of Oscillation Detection/Storage Section)

Figure 3:
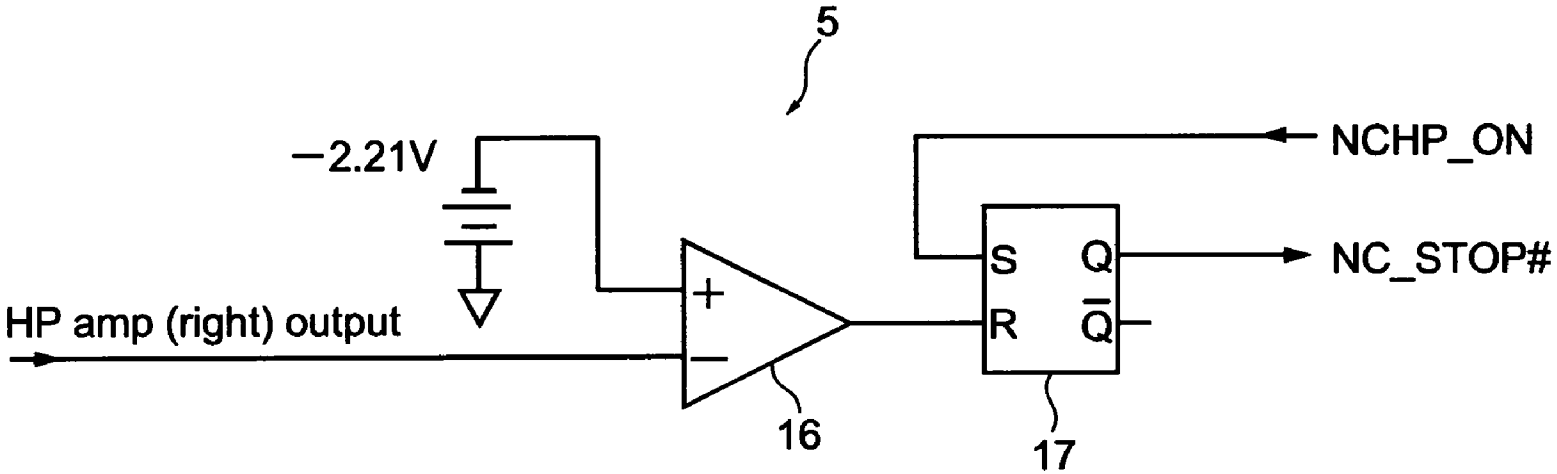
FIG. 3 is a diagram showing a structure of an oscillation detection/storage section shown in FIG. 1.

FIG. 3 is a diagram showing a structure of the oscillation detection/storage section 5 shown in FIG. 1.

As shown in FIG. 3, the oscillation detection/storage section 5 includes a comparator 16 and a flip-flop 17.

The comparator 16 includes a negative input terminal, a positive input terminal, and an output terminal. The negative input terminal is connected with an output line of the audio amplifier 8. The positive input terminal is applied with a voltage of −2.21 V. The output terminal is connected to a reset terminal of the flip-flop 17.

The flip-flop 17 includes the reset terminal R, a set terminal S, an output terminal Q, and an inverting output terminal/Q. The reset terminal R is connected with the output terminal of the comparator 16. The set terminal S is input with a signal (signal with which the noise-canceling function is turned off) from the OS 2. The output terminal Q is connected to the switches 14 and 15. The switches 14 and 15 are turned on/off in accordance with the output of the output terminal Q.

As a result, when an oscillation (howling) is generated, a voltage exceeding 2.21 V is applied to the negative input terminal of the comparator 16 and then the flip-flop 17 is reset (stored), with the result that the switches 14 and 15 are turned off.

In this embodiment, generation of an oscillation is detected based on the output of the audio amplifier 8. Accordingly, the generation of an oscillation can be detected accurately. Since the output of the audio amplifier 8 does not exceed a predetermined level (2.21 V in terms of voltage) in a normal condition in which an oscillation is not caused, the generation of an oscillation can be detected reliably.

(Structure of Malfunction Prevention Section)

Figure 4:
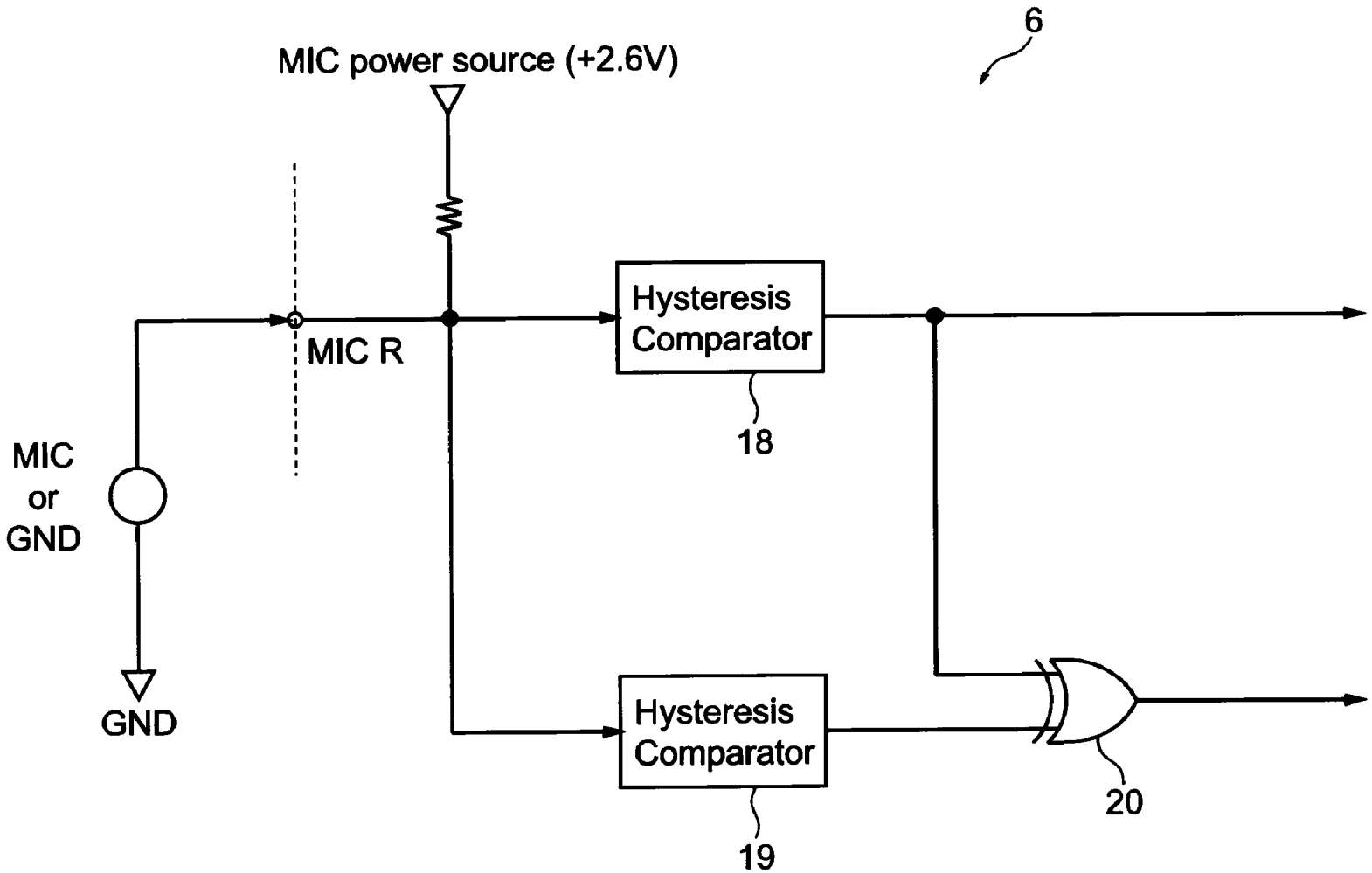
FIG. 4 is a diagram showing a structure of a malfunction prevention section shown in FIG. 1.

FIG. 4 is a diagram showing a structure of the malfunction prevention section 6 shown in FIG. 1.

As shown in FIG. 4, the malfunction prevention section 6 includes hysteresis comparators 18 and 19 and an exclusive NOR circuit 20.

Figure 5:
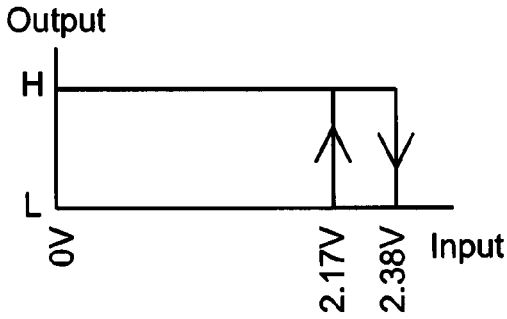
FIG. 5 is a diagram showing characteristics of a hysteresis comparator shown in FIG. 4.

The hysteresis comparator 18 includes an input terminal and an output terminal. The input terminal of the hysteresis comparator 18 is connected with the connector terminal MIC R. To the connector terminal MIC R, a microphone power supply (2.6 V) is connected via a resistor. The output terminal of the hysteresis comparator 18 is connected to the OS 2 side and one input terminal of the exclusive NOR circuit 20. As shown in FIG. 5, when a voltage applied to the input terminal of the hysteresis comparator 18 exceeds 2.38 V in a state in which the hysteresis comparator 18 outputs H from the output terminal thereof, the hysteresis comparator 18 outputs L from the output terminal. When the voltage applied to the input terminal is set to 2.17 V or less in a state in which the hysteresis comparator 18 outputs L from the output terminal, the hysteresis comparator 18 outputs H from the output terminal. As a result, when a microphone plug terminal of a headphone or a three-pole plug of a headphone (headphone noncompliant with noise-canceling) is connected to the connector terminal MIC R, the output terminal of the hysteresis comparator 18 outputs H. Accordingly, the OS 2 side recognizes that some plug is inserted into the jack 7.

Figure 6:
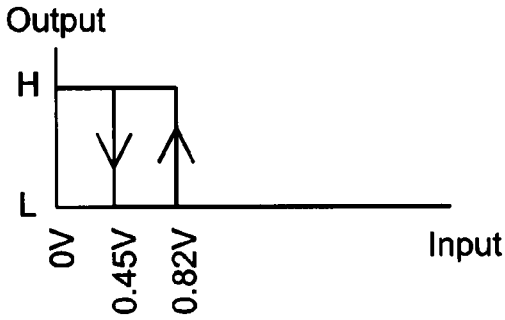
FIG. 6 is a diagram showing characteristics of another hysteresis comparator shown in FIG. 4.

The hysteresis comparator 19 includes an input terminal and an output terminal. The input terminal of the hysteresis comparator 19 is connected with the connector terminal MIC R. To the connector terminal MIC R, the microphone power supply (2.6 V) is connected via the resistor. The output terminal of the hysteresis comparator 19 is connected to the other input terminal of the exclusive NOR circuit 20. As shown in FIG. 6, when a voltage applied to the input terminal of the hysteresis comparator 19 exceeds 0.45 V in a state in which the hysteresis comparator 19 outputs H from the output terminal thereof, the hysteresis comparator 19 outputs L from the output terminal. When the voltage applied to the input terminal is set to 0.82 V or less in a state in which the hysteresis comparator 19 outputs L from the output terminal, the hysteresis comparator 19 outputs H from the output terminal.

Figure 7:
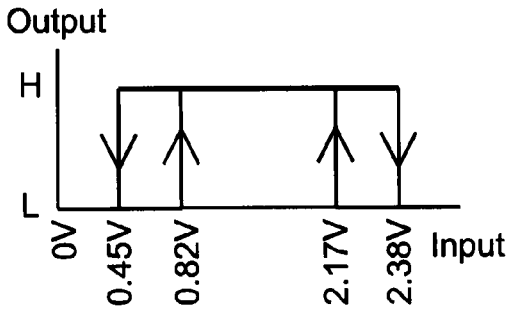
FIG. 7 is a diagram showing an output of an exclusive NOR circuit show in FIG. 4.

The exclusive NOR circuit 20 includes the two input terminals and an output terminal. The one input terminal of the exclusive NOR circuit 20 is connected with the output terminal of the hysteresis comparator 18. The other input terminal of the exclusive NOR circuit 20 is connected with the output terminal of the hysteresis comparator 19. As shown in FIG. 7, when a voltage applied to the input terminals of the exclusive NOR circuit 20 exceeds 2.38 V or is equal to or smaller than 0.45 V in a state in which the exclusive NOR circuit 20 outputs H from the output terminal thereof, the exclusive NOR circuit 20 outputs L from the output terminal. When the voltage applied to the input terminals is set to 2.17 V or less or is equal to or larger than 0.82 V in a state in which the exclusive NOR circuit 20 outputs L from the output terminal, the exclusive NOR circuit 20 outputs H from the output terminal. As a result, when a microphone plug terminal of a headphone is correctly connected to the connector terminal MIC R, the output terminal of the exclusive NOR circuit 20 outputs H. Accordingly, the switches 14 and 15 are turned on and the signals output from the noise-canceling sections 10 and 11 are output to the adders 12 and 13. That is, the noise-canceling function is turned on.

(Operation of Oscillation Detection/Storage Section)

Figure 8:
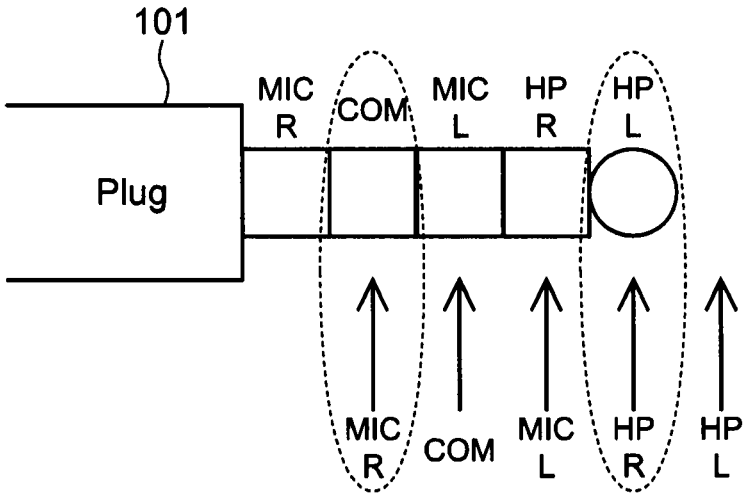
FIG. 8 is a diagram showing a relationship between a plug and a jack when an oscillation (howling) is generated.

FIG. 8 shows a state in which a plug 101 of a headphone including a microphone (noise-canceling headphone) is incompletely inserted into the headphone-connecting jack 7 shown in FIG. 2. Specifically, FIG. 8 shows a state in which a plug terminal HP L of the plug 101 is connected to the connector terminal HP R of the headphone-connecting jack 7 and a plug terminal COM of the plug 101 is connected to the connector terminal MIC R of the headphone-connecting jack 7.

Figure 9:
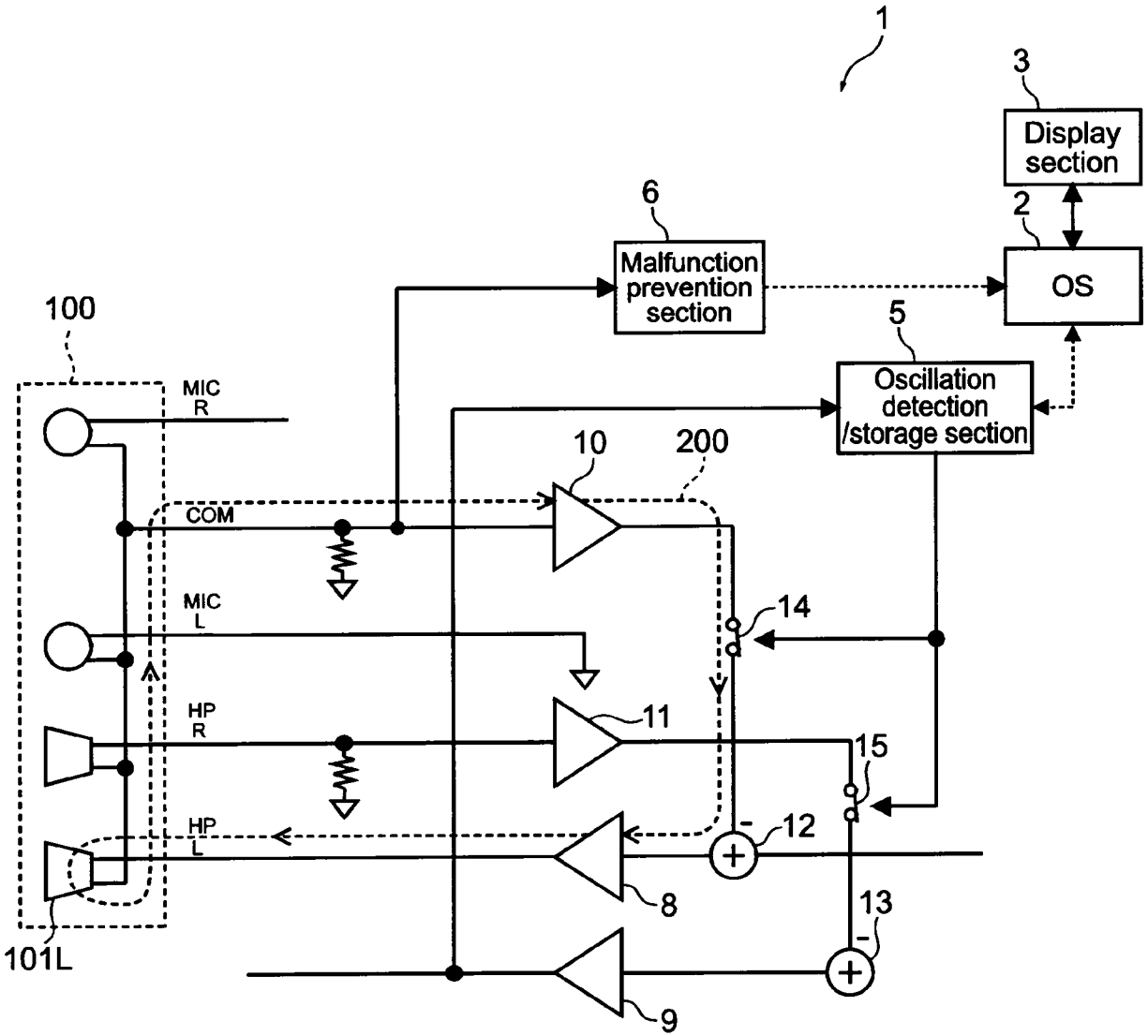
FIG. 9 is a diagram for explaining a path in which an oscillation (howling) is generated.

FIG. 9 shows a structure of a circuit formed between the audio section 4 and the headphone 100 described above in the above case. Here, the switches 14 and 15 are turned on and the noise-canceling function is turned on.

In this state, a loop circuit 200 is formed as indicated by a dotted line in FIG. 9. The loop circuit 200 includes the audio amplifier 8, the connector terminal HP R of the headphone-connecting jack 7, the plug terminal HP L of the plug 101, and a speaker 101L. The loop circuit 200 further includes the plug terminal COM of the plug 101, the connector terminal MIC R of the headphone-connecting jack 7, the noise-canceling section 10, the switch 14, and the adder 12.

When such a loop circuit is formed, an oscillation (howling) is generated, an oscillation noise is output from the headphone 100, and a larger voltage than in a normal case of a maximum volume appears in the output of the audio amplifier 8. The oscillation detection/storage section 5 detects such a large voltage that appears in the output of the audio amplifier 8 and stores a state thereof.

Specifically, when an oscillation (howling) is generated, a voltage exceeding 2.21 V is applied to the negative input terminal of the comparator 16 of the oscillation detection/storage section 5, and the flip-flop 17 is reset. That is, the generation of an oscillation (howling) is stored by the flip-flop 17.

When the flip-flop 17 of the oscillation detection/storage section 5 is reset, the switch 14 is turned off by the output of the output terminal Q of the flip-flop 17. Accordingly, a signal path of the noise-canceling function (loop circuit 200) is disconnected, with the result that an oscillation (howling) is suppressed. In other words, according to this embodiment, since the noise-canceling function is regulated when the oscillation detection/storage section 5 detects an oscillation (howling), an oscillation (howling) is prevented from being generated.

(Operation of Malfunction Prevention Section)

Figure 10:
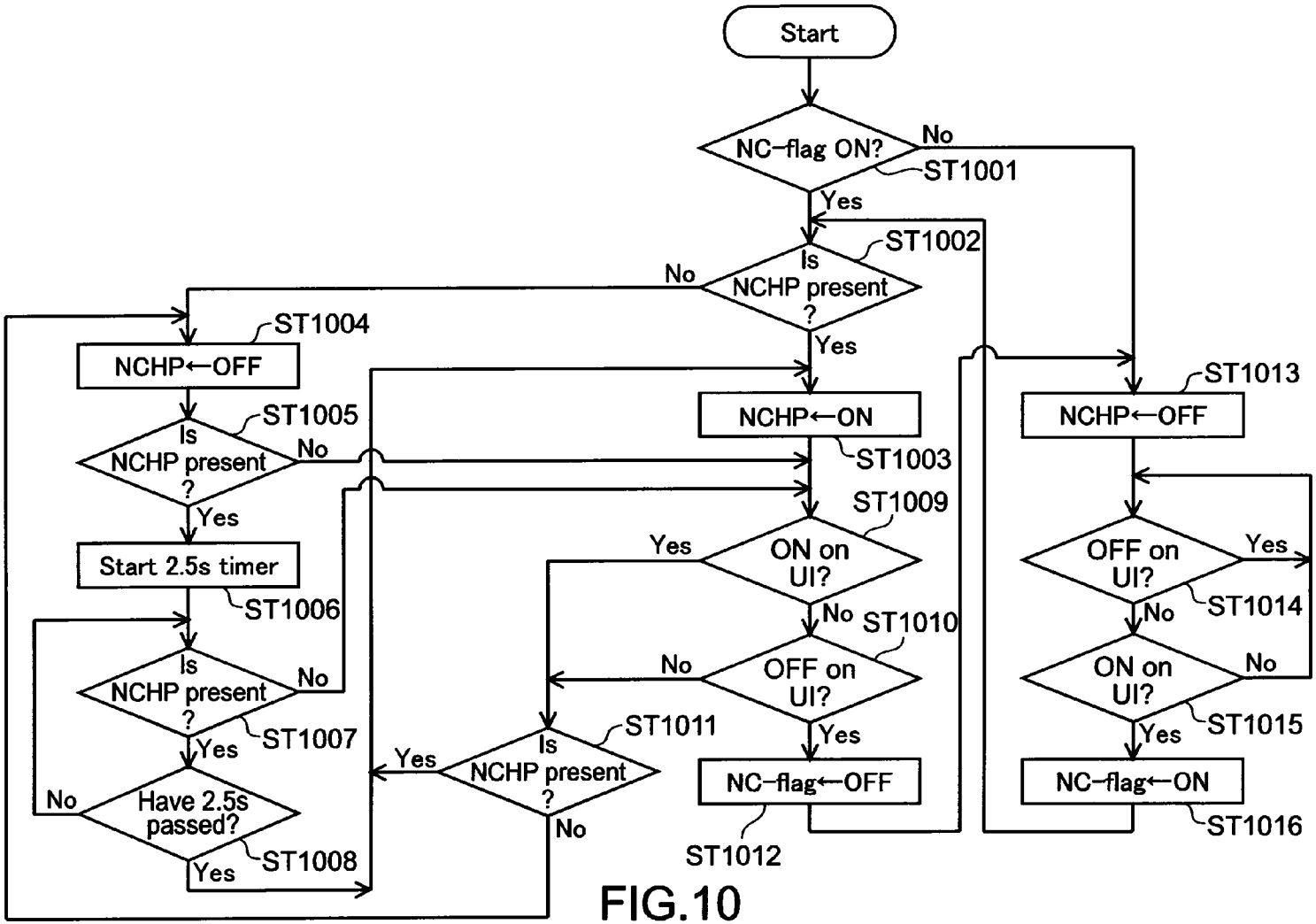
FIG. 10 is a flowchart showing an operation related to malfunction prevention.

FIG. 10 is a flowchart showing an operation related to malfunction prevention on the OS 2 side.

When a power source of the information processing apparatus 1 is turned on, the OS 2 is activated and then judges whether an NC-Flag (flag that is set in accordance with validity/invalidity of noise-canceling function) is in on-state (Step 1001). That is, the OS 2 determines whether to set the noise-canceling function valid.

When judging in Step 1001 that the NC-Flag is in on-state, the OS 2 judges whether the noise-canceling headphone is connected (Step 1002). This is judged based on whether H is output from the output terminal of the exclusive NOR circuit 20 of the malfunction prevention section 6.

When judging in Step 1002 that the noise-canceling headphone is connected, the OS 2 actually turns on a circuit function for noise-canceling (Step 1003). This operation is performed by the OS 2, which outputs a signal for turning on the noise-canceling function (H, for example) to the set terminal of the flip-flop 17 of the oscillation detection/storage section 5 and turns on the switches 14 and 15.

When judging in Step 1002 that the noise-canceling headphone is not connected, the OS 2 actually turns off the circuit function for noise-canceling (Step 1004). This operation is performed by the OS 2, which outputs a signal for turning off the noise-canceling function (H, for example) to the reset terminal of the flip-flop 17 of the oscillation detection/storage section 5 and turns off the switches 14 and 15.

After turning off the circuit function for noise-canceling in Step 1004, the OS 2 judges whether some headphone is connected (Step 1005). This is judged based on whether H is output from the output terminal of the hysteresis comparator 18 of the malfunction prevention section 6.

When judging in Step 1005 that some headphone is connected, the OS 2 activates a 2.5 second-timer, for example (Step 1006).

During 2.5 seconds, the OS 2 judges whether the noise-canceling headphone is connected (Steps 1007 and 1008). This is judged based on whether H is output from the output terminal of the exclusive NOR circuit 20 of the malfunction prevention section 6.

When the noise-canceling headphone is connected during 2.5 seconds (Step 1008), the OS 2 actually turns on the circuit function for noise-canceling (Step 1003). This operation is performed by the OS 2, which outputs a signal for turning on the noise-canceling function (H, for example) to the set terminal of the flip-flop 17 of the oscillation detection/storage section 5 and turns on the switches 14 and 15.

After performing processing of Step 1003, No in Step 1005, and No in Step 1007, the OS 2 monitors switching of the noise-canceling function on the user interface (UI) displayed on the display section 3 described later (Step 1009). That is, the OS 2 monitors whether a user turns on the noise-canceling function by an operation on the UI screen in Step 1009 and if the user has not performed any operation, the OS 2 immediately passes Step 1009. In Step 1010, the OS 2 monitors whether the user turns off the noise-canceling function by an operation on the UI screen and if the user has not performed any operation, the OS 2 immediately passes Step 1010.

In a case of Yes in Step 1009 or No in Step 1010, that is, in a case where the noise-canceling function is turned on, the OS 2 judges whether the noise-canceling headphone is connected (Step 1011). This is judged based on whether H is output from the output terminal of the exclusive NOR circuit 20 of the malfunction prevention section 6.

When judging in Step 1011 that the noise-canceling headphone is connected, the OS 2 executes the processing of Step 1003 and its subsequent steps. When judging in Step 1011 that the noise-canceling headphone is not connected, the OS 2 executes the processing of Step 1004 and its subsequent steps.

In a case of Yes in Step 1010, that is, in a case where the user turns off the noise-canceling function by an operation on the UI screen, the OS 2 turns off the NC-Flag (Step 1012) and actually turns off the circuit function for noise-canceling (Step 1013). This operation is performed by the OS 2, which outputs a signal for turning off the noise-canceling function (H, for example) to the reset terminal of the flip-flop 17 of the oscillation detection/storage section 5 and turns off the switches 14 and 15.

After turning off the circuit function for noise-canceling in Step 1013, the OS 2 monitors switching of the noise-canceling function on the user interface (UI) displayed on the display section 3 described later (Step 1014). That is, the OS 2 monitors whether the user turns off the noise-canceling function by an operation on the UI screen in Step 1014 and if the user has not performed any operation, the OS 2 immediately passes Step 1014. In Step 1015, the OS 2 monitors whether the user turns on the noise-canceling function by an operation on the UI screen and if the user has not performed any operation, the OS 2 immediately passes Step 1015.

In a case of Yes in Step 1015, that is, in a case where the user turns on the noise-canceling function by an operation on the UI screen, the OS 2 turns on the NC-Flag (Step 1016) and executes the processing of Step 1002 and its subsequent steps.

Here, when the noise-canceling function is temporarily turned off due to the oscillation prevention operation by the oscillation detection/storage section 5, the off-state continues until the user reinserts the plug 101 of the headphone 100 or releases the off-state of the noise-canceling function by an operation on the UI screen.

In the case where the user reinserts the plug 101 of the headphone 100, the plug 101 enters the state shown in FIG. 8 in the middle of the reinsertion. When an oscillation occurs in this state, the noise-canceling function is turned off again due to the oscillation prevention operation by the oscillation detection/storage section 5.

That is, there is a fear that the noise-canceling function may be turned off due to the oscillation prevention operation by the oscillation detection/storage section 5 each time the plug 101 of the headphone 100 is inserted. To avoid the circumstances as described above, the oscillation prevention operation in this embodiment makes the noise-canceling function invalid during 2.5 seconds after it is detected that the plug 101 starts to be inserted (Steps 1005 to 1008).

In a case where a period of time extending from the insertion start of the plug 101 to the completion of the insertion is long, the oscillation prevention operation by the oscillation detection/storage section 5 may act in some cases. However, the insertion is generally completed 2.5 seconds or shorter unless the user has any particular intention. Accordingly, a period of time during which the noise-canceling function is made invalid is set to 2.5 seconds in this embodiment. It should be noted that this period of time is merely an example and may be shorter or longer than the set period of time in some cases.

(Specific Example of User Interface)

Next, a specific example of the user interface (UI) related to the noise-canceling function will be described.

Figure 11:
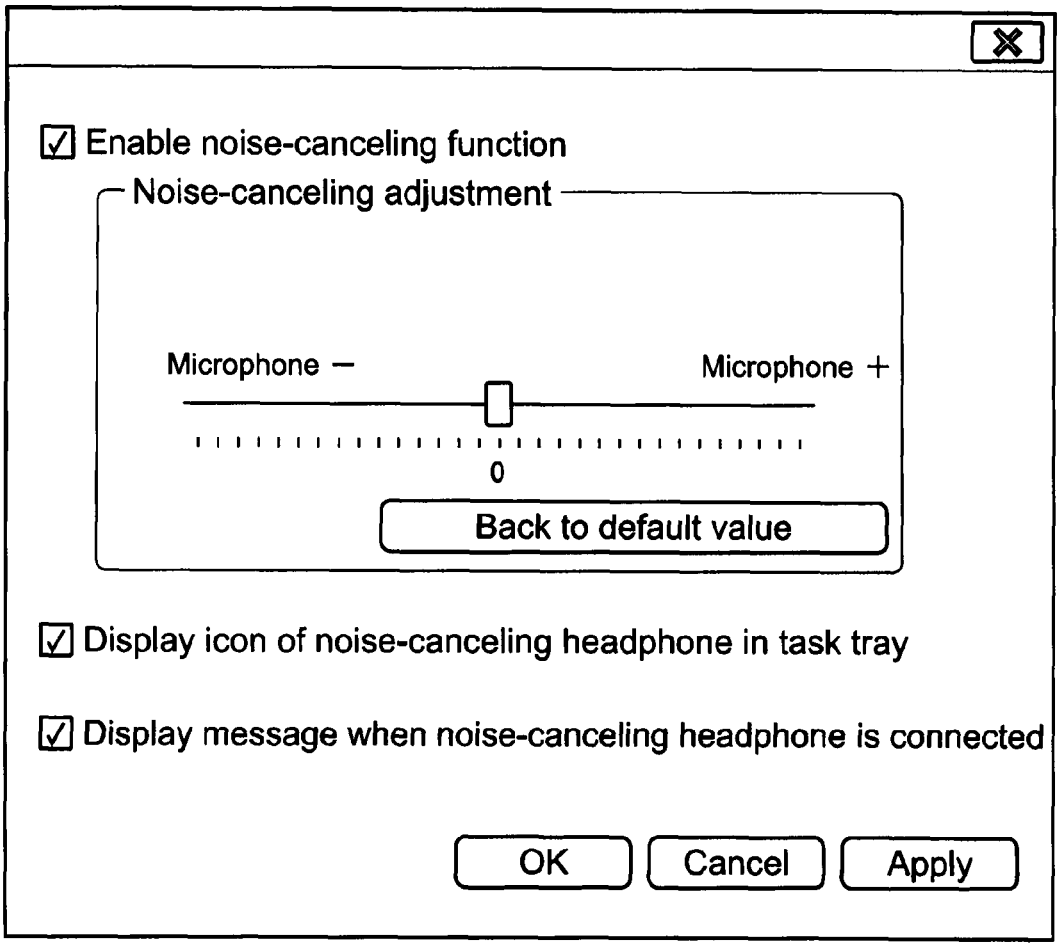
FIG. 11 is a diagram showing a specific example of a user interface (UI) screen related to a noise-canceling function.

FIG. 11 is a diagram showing the user interface (UI) screen displayed on the display section 3 under control of the OS 2.

As shown in FIG. 11, the UI screen includes three check boxes.

The uppermost check box is a button for the user to switch the noise-canceling function into valid/invalid states.

A slider at the center is used for adjusting an amount of noise to be inversely added by the noise-canceling function. The user makes adjustment by the slider such that optimum cancellation performance is obtained. A default value is the center value. When a button of "Back to default value" is pressed, the slider returns to the center position.

The lowermost check box is a button for switching display and nondisplay of a message indicating that a headphone provided with the noise-canceling function is connected on the screen. By enabling such a message to be displayed, it is possible for the user to know whether the headphone supports the noise-canceling function while seeing the screen.

All the operations described above are made valid by pressing a button "Apply" on the lower right-hand side.

Another Embodiment

Figure 12:
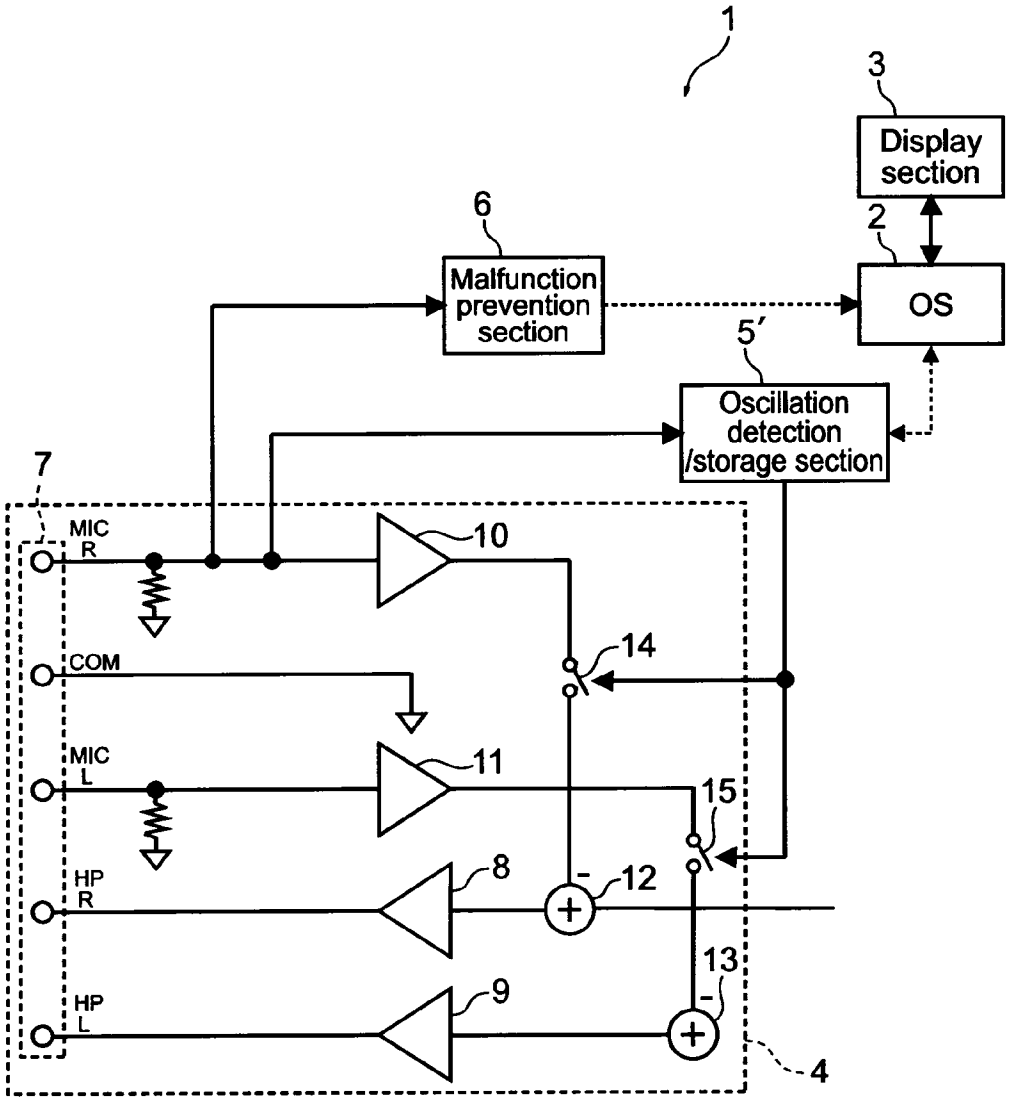
FIG. 12 is a diagram showing a structure of an information processing apparatus according to another embodiment of the present invention.

FIG. 12 is a diagram showing a structure of an information processing apparatus according to another embodiment of the present invention.

The information processing apparatus according to the embodiment shown in FIG. 1 detects generation of an oscillation based on an output of the audio amplifier 8. On the other hand, as shown in FIG. 12, the information processing apparatus 1 according to this embodiment detects generation of an oscillation on an input side of the noise-canceling section 10, that is, based on a microphone input signal of a headphone.

Figure 13:
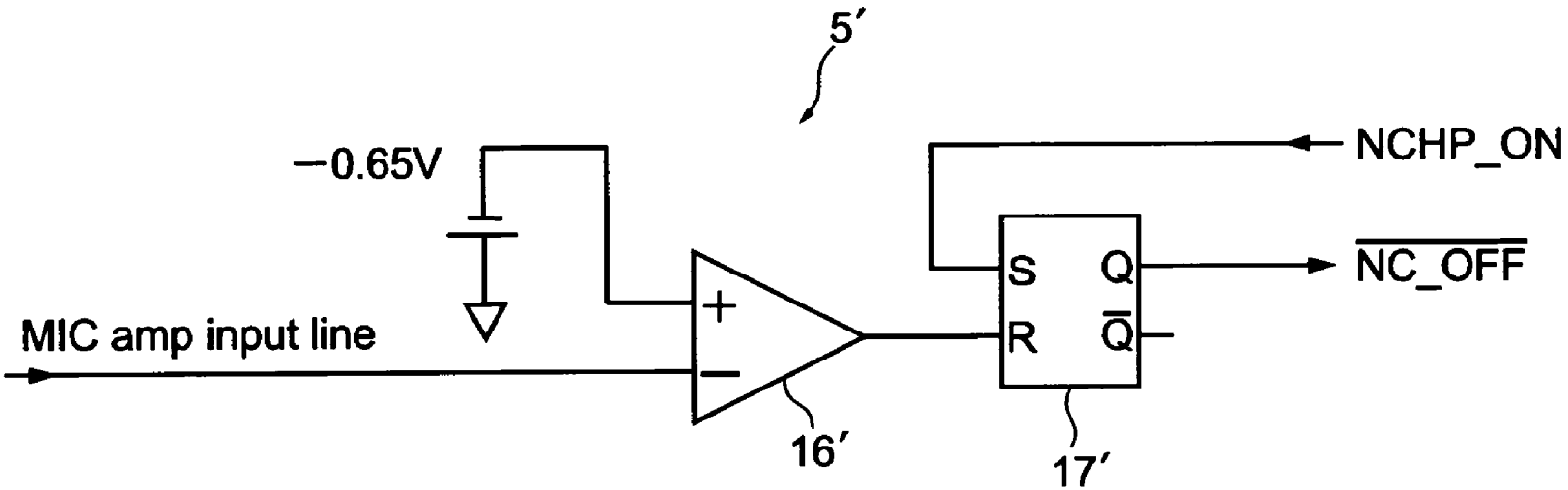
FIG. 13 is a diagram showing a structure of an oscillation detection/storage section shown in FIG. 12.

FIG. 13 is a diagram showing a structure of an oscillation detection/storage section 5' shown in FIG. 12.

As shown in FIG. 13, the oscillation detection/storage section 5' includes a comparator 16' and a flip-flop 17'.

The comparator 16' includes a negative input terminal, a positive input terminal, and an output terminal. The negative input terminal is connected with the microphone input terminal MIC R. The positive input terminal is applied with a voltage of −0.65 V. The output terminal is connected to a reset terminal of the flip-flop 17'.

The flip-flop 17' includes the reset terminal R, a set terminal S, an output terminal Q, and an inverting output terminal/Q. The reset terminal R is connected with the output terminal of the comparator 16'. The set terminal S is input with a signal (signal with which the noise-canceling function is turned on) from the OS 2. The output terminal Q is connected to the switches 14 and 15. The switches 14 and 15 are turned on/off in accordance with the output of the output terminal Q.

As a result, when an oscillation (howling) is generated, a voltage exceeding 0.65 V is applied to the negative input terminal of the comparator 16' and the flip-flop 17' is reset (stored), with the result that the switches 14 and 15 are turned off.

The present invention is not limited to the embodiments described above and modifications thereof can be implemented within the range of the technical idea of the present invention. The range of the implementation also falls within the technical range of the present invention.

For example, the present invention is applied to a laptop personal computer in the embodiments described above. However, the present invention is not limited to the above, and can be of course applied to another information processing apparatus such as a cellular phone and a portable music player.

In the embodiments described above, the generation of an oscillation is detected based on an output of the audio amplifier or an input of the noise-canceling section. However, the generation of an oscillation may be of course detected by assigning predetermined weights to both the output and input described above.

In the embodiments described above, the generation of an oscillation is detected using one channel line in the structure of stereo audio equipment. However, the generation of an oscillation may be of course detected using two channel lines.

The headphone described in the above embodiments includes an earphone.

The present application contains subject matter related to that disclosed in Japanese Priority Patent Application JP 2008-334212 filed in the Japan Patent Office on Dec. 26, 2008, the entire content of which is hereby incorporated by reference.

What is claimed is:

1. An information processing apparatus comprising:

a jack that is connectable with a plug of a headphone including a microphone, outputs a first signal to the headphone, and inputs a second signal from the microphone;

a noise-canceling section to generate a third signal that cancels a noise component around the headphone based on the second signal input from the jack and enable an operation of superposing the third signal on the first signal;

a judgment section to judge whether at least one of the first signal and the second signal exceeds a predetermined level;

a first regulation section to regulate an operation of the noise-canceling section when the judgment section judges that the predetermined level is exceeded;

a first detection section to detect that a plug is connected to the jack; and a second regulation section to regulate the operation of the noise-canceling section for a predetermined period of time after the first detection section detects that the plug is connected to the jack.

2. The information processing apparatus according to claim 1, further comprising:

a second detection section to detect that the plug of the headphone including the microphone is connected to the jack; and a release section to release the regulation on the operation of the noise-canceling section by the second regulation section when the second detection section detects that the plug of the headphone including the microphone is connected to the jack.

3. An information processing apparatus, comprising:

a jack that is connectable with a plug of a headphone including a microphone, outputs a first signal to the headphone, and inputs a second signal from the microphone;

a noise-canceling section to generate a third signal that cancels a noise component around the headphone based on the second signal input from the jack and superpose the third signal on the first signal;

a switch to make a switch as to whether the third signal is superposed on the first signal;

a comparator to compare one of a first voltage of the first signal and a second voltage of the second signal with a predetermined third voltage and output a fourth signal when one of the first voltage and the second voltage exceeds the third voltage;

a flip-flop that is capable of holding the fourth signal and outputs a fifth signal with which the switch is turned off when the flip-flop holds the fourth signal;

a control section to output a sixth signal with which the switch is turned on, wherein the flip-flop is capable of holding the sixth signal and turns on the switch when flip-flop holds the sixth signal, and the jack includes a microphone input terminal;

a power source to supply power to the microphone input terminal; and a first hysteresis comparator to compare a fourth voltage applied to the microphone input terminal with a predetermined fifth voltage and output a seventh signal when the fourth voltage is lower than the fifth voltage, wherein the control section turns off the switch for a predetermined period of time when the first hysteresis comparator outputs the seventh signal.

4. The information processing apparatus according to claim 3, further comprising a second hysteresis comparator to compare the fourth voltage applied to the microphone input terminal with a predetermined sixth voltage set to be lower than the fifth voltage and output an eighth signal when the fourth voltage is in a range between the fifth voltage and the sixth voltage, wherein the control section turns on the switch when the second hysteresis comparator outputs the eighth signal.

5. An information processing method, comprising:

generating, based on a second signal input from a jack that is connectable with a plug of a headphone including a microphone, outputs a first signal to the headphone, and inputs the second signal from the microphone, a third signal that cancels a noise component around the headphone;

superposing the third signal on the first signal;

judging whether at least one of the first signal and the second signal exceeds a predetermined level;

regulating the superposing the third signal on the first signal when it is detected that the predetermined level is exceeded;

detecting that a plug is connected to the jack; and regulating the superimposing the third signal on the first signal for a predetermined period of time after detecting that the plug is connected to the jack.

* * * * *